United States Patent [19]

Hartleif

[11] Patent Number: 4,944,129

[45] Date of Patent: Jul. 31, 1990

[54] CEILING LINING

[75] Inventor: Karl-Heinz Hartleif, Reilingen, Fed. Rep. of Germany

[73] Assignee: Hartleif Metalldecken GmbH, Hockenheim, Fed. Rep. of Germany

[21] Appl. No.: 347,802

[22] PCT Filed: Aug. 17, 1988

[86] PCT No.: PCT/EP88/00735

§ 371 Date: May 23, 1989

§ 102(e) Date: May 23, 1989

[87] PCT Pub. No.: WO89/01551

PCT Pub. Date: Feb. 23, 1989

[30] Foreign Application Priority Data

Aug. 18, 1987 [DE] Fed. Rep. of Germany ..... 8711244

[51] Int. Cl.[5] ..... E04B 5/52

[52] U.S. Cl. ..... 52/486; 52/484; 52/474; 52/488

[58] Field of Search ..... 52/484, 486, 489, 488, 52/779, 474

[56] References Cited

U.S. PATENT DOCUMENTS

| | | | |
|---|---|---|---|
| 3,327,438 | 6/1967 | Cooper | 52/205 |
| 3,596,425 | 8/1971 | Kodaras | 52/484 X |
| 3,602,473 | 8/1971 | Van Riet | 52/484 X |
| 4,678,487 | 7/1987 | Cadwell, Jr. et al. | 52/484 X |

FOREIGN PATENT DOCUMENTS

| | | | |
|---|---|---|---|
| 1102995 | 3/1961 | Fed. Rep. of Germany . | |
| 2624956 | 8/1977 | Fed. Rep. of Germany . | |
| 3142451 | 5/1983 | Fed. Rep. of Germany . | |
| 1392544 | 1/1964 | France | 52/484 |
| 1104685 | 2/1968 | United Kingdom . | |

*Primary Examiner*—Carl D. Friedman
*Assistant Examiner*—Linda J. Hoffert
*Attorney, Agent, or Firm*—Krass & Young

[57] ABSTRACT

A metallic ceiling lining consists of a supporting grid of longitudinal struts and transverse struts and cassettes arranged in the grid compartments. The longitudinal struts and transverse struts have their lower ends. The cassettes rest in a gastight manner on the projections and the longitudinal struts are designed as essentially rectangular hollow profiles. To permit the attachment of ancillary devices such as lights or partitions witout impairing the gastightness of the ceiling lining, the hollow profile is designed as a closed duct and the longitudinal strut also has a region of tubular cross-section for mounting suspended elements. The invention is applicable to all types of gastight ceiling linings.

23 Claims, 9 Drawing Sheets

CEILING LINING

The present invention relates to a ceiling lining of metal, consisting of a supporting grid and of cassettes arranged in the grid compartments of the supporting grid which is composed of longitudinal struts and of transverse struts connected to said longitudinal struts, each longitudinal strut and each transverse strut having projections which are arranged on either side at the lower ends of said struts, extend in the longitudinal directions thereof, are provided with seals, and rest in a tight manner on the cassettes, the longitudinal struts being designed as essentially rectangular hollow profiles.

Ceiling linings of metal are used preferably to seal off rooms in the clinical field, in laboratories, or to provide gas-tight sealing of the ceilings of super-purity rooms in manufacturing facilities. Since the ceiling surfaces are often very large, a sufficient gas-tightness must be guaranteed on the one hand, and the ceiling lining must meet high optical requirements on the other hand.

From West German Patent 26 24 956 there is known a suspended ceiling in which, for the sake of saving material, the support bars are provided with a hollow space. Said hollow space may have various forms which are matched, depending on the material to be saved, with the respective forms of the support bars. There is, however, no possibility of attaching ancillary devices to the support bars without impairing the tightness thereof.

The present invention is based upon the problem of providing a ceiling lining of the above mentioned kind, which is of simple structure, optically pleasant, provides safe tightness and permits the mounting of additional ancillary devices or installations.

According to the present invention, this problem is solved in that the hollow profile is designed in form of a closed duct and that further the longitudinal strut has a region of tubular cross-section for mounting suspended elements.

The ceiling lining is characterized by a number of significant advantages. Since the longitudinal strut comprises not only a duct but also a cross-sectional region, it can be suspended irrespective of any other installations mounted thereto. On the one hand, electrical cables or other conduits, e.g. water conduits to be connected to a sprinkler installation, can be guided in the closed duct, and on the other hand, ancillary devices such as partitions, additional lamps or the like, can be attached to the undersides of the longitudinal struts, and screws, dowels or rivets which are used for attaching purposes can neither penetrate said longitudinal strut nor cause any untightness. This is particularly advantageous in those cases when in a very large room installations such as e.g. partitions are to be mounted for a limited period of time only. When such installations are removed at a later time, the boreholes which may possibly remain in the longitudinal struts do not impair the tightness of the ceiling lining. As the longitudinal struts exhibit a sufficient rigidity, it is possible according to the invention to attach further ancillary devices even of larger weight such as e.g. lights in the medical field, suspensions for laboratory apparatuses or the like. Advantageously, there may be projections which are designed as ducts. In such embodiment there are then two ducts available in each longitudinal strut so that the possibilities of applying ancillary devices are considerably increased.

In a particularly advantageous embodiment the longitudinal strut is designed in such manner that the duct is arranged in the middle section thereof and the region of tubular cross-section is arranged thereabove. Due to such design the longitudinal strut may be narrower, and additionally it is excluded that unintentional through-bores causing untightness are made through any parts of the longitudinal strut.

In order to provide a simple possibility of suspending the longitudinal struts, it may be of advantage that the region of tubular cross-section be U-shaped so that suspension elements can be suspended therein. In such embodiment it is not required to fasten the suspended elements by means of additional connecting members, e.g. screws, but rather the suspended elements can be suspended immediately in the longitudinal struts.

In a particular advantageous embodiment the longitudinal strut is designed essentially rectangular and comprises a horizontal separating web for separating the duct from the region of tubular cross-section. This design provides substantial advantages in respect of the rigidity properties of the longitudinal strut. Further, the duct may be designed in such manner that a damaging of the horizontal separating web during the mounting of ancillary devices, e.g. by drill tools or the like, is safely excluded.

In order to ensure that the cassettes fit particularly well to the longitudinal and transverse struts, it can be provided according to the invention that the cassette has a circumferential step-like fold extending along its lower outer edge and that it rests with the horizontal surface of said step-like fold upon the projections in such manner that the undersides of the cassette, of the longitudinal struts and of the transverse struts are arranged in one plane.

In order to secure the cassettes and to press them with a sufficient force against the seals, it can be provided according to the invention that spring members which secure the cassettes in their positions are held on the longitudinal struts and/or on the transverse struts. Advantageously, the spring members may be designed as leaf springs, the ends of which are supported in grooves which are arranged and opposing each other in the side walls of the longitudinal or transverse struts. According to another embodiment of the invention, the grooves may be defined by a respective side wall and a parallel web extending downward from the upper end of the side wall on the one hand, and by a web which is arranged on the top side of the projection and extends upward parallel to the side wall, on the other hand.

In order to ensure that the cassettes can be mounted and removed in a simple manner, the spring members may have between their two ends an angular portion whose one leg extends in a substantially vertical direction, is resiliently supported against the lateral face of the cassette and extends approximately as far as the upper edge of the cassette, and whose other leg extends above the upper edge of the cassette and is angularly bent, sloping upward and inclined outward with respect to the side wall of the strut. Further, it may be favorable that one leg is followed by a leg extending preferably in a straight line to the lower groove, and that the other leg is followed by a leg extending preferably in a straight line to the upper groove.

Examples of embodiment of the present invention are described hereinafter more in detail, reference being had to the accompanying drawings in which FIG. 1 is a view from below of a portion of the supporting grid according to the invention;

Figure 3:
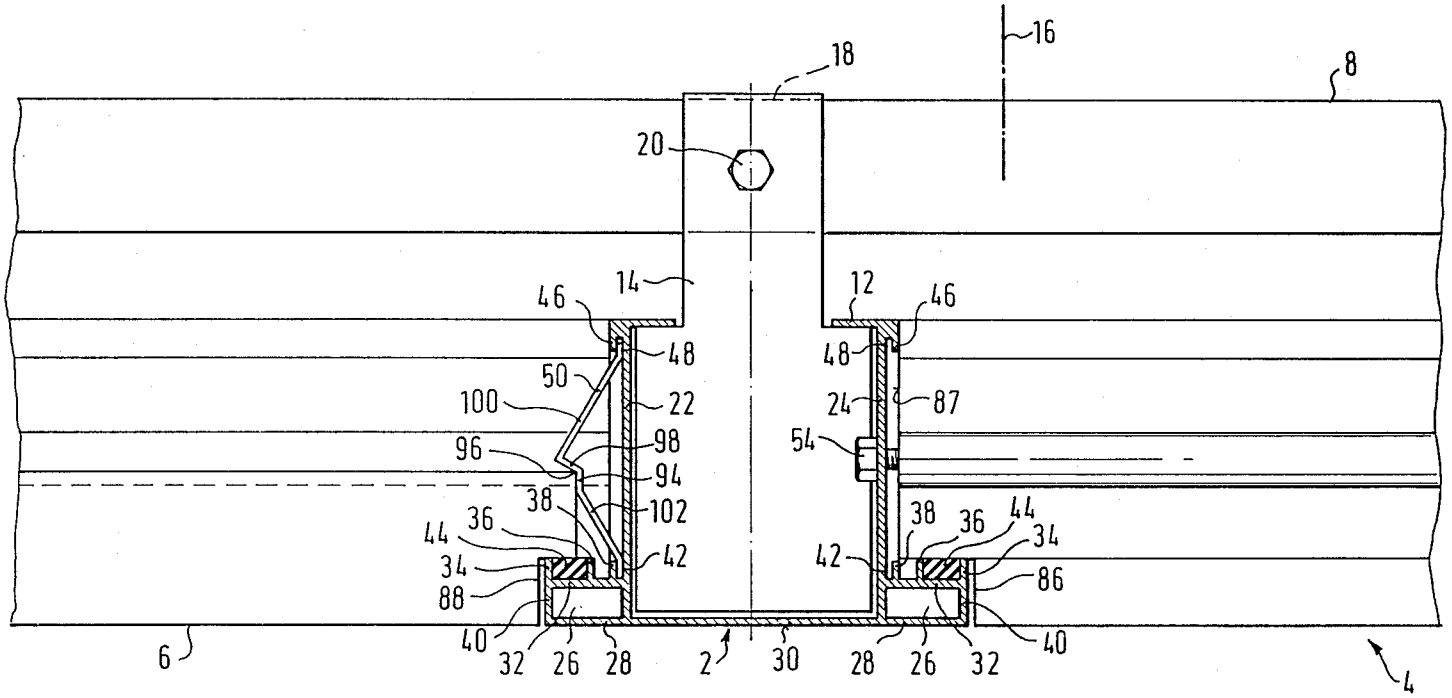
FIG. 3 is a sectional view along the line III/III according to FIG. 1 through a longitudinal strut of the supporting grid with a cassette in the assembled condition.
Figure 4:
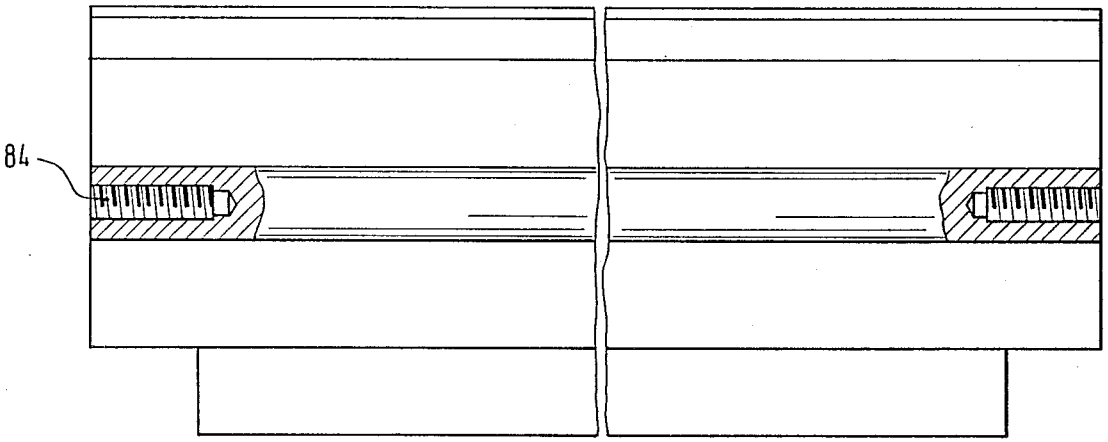
FIG. 4 is a side view of a transverse strut according to FIG. 1, partly sectioned.

The ceiling lining according to the present invention consists substantially of parallel longitudinal struts 2 which are horizontally arranged, of transverse struts 4 which are arranged between the longitudinal struts 2 and whose ends are fastened to the longitudinal struts, and of cassettes 6 which are carried by the longitudinal struts 2 and the transverse struts 4. As can be seen in FIG. 3, the longitudinal struts 2 are fastened to girders 8 via suspension tongues 14 extending upward from the top side 12 of the longitudinal struts 2, said girders 8 being adjustable in height, e.g. by means of thread rods 16, relative to the room ceiling (not shown). The suspension tongues 14 of the longitudinal struts 2 are angularly bent at their upper ends, whereby the longitudinal struts can be suspended on the girders 8 by means of the horizontal angle leg 18 of the suspension tongue 14. In addition, the suspension tongues 14 are secured to the girders 8 by means of screws 20.

The longitudinal struts 2 and the transverse struts 4 are made as aluminum profiles. The cassettes 6 carried by the longitudinal struts 2 and the transverse struts 4 are made of electrolytically zinc-coated sheet steel. The visible sides both of the cassettes 6 and of the longitudinal struts 2 as well as of the transverse struts 4 are coated with thermoset lacquer having e.g. the shade RAL 9010.

The form of the longitudinal struts 2 can be seen particularly in FIG. 3. The longitudinal struts 2 are designed as essentially rectangular box profiles, the top side 12 of the box profile being opened for the most part in order to make the interior thereof accessible. Along the two long sides 22, 24 of the box profile there are arranged laterally projecting continuous supports 26 extending in the longitudinal direction of the longitudinal struts. These supports 26 also have a box profile-like design, and their undersides 28 are in a plane with the underside 30 of the box profile-like longitudinal strut 2.

On the upward-facing top side 32 of each support 26 there are disposed three vertical webs 34, 36, 38 extending in the longitudinal direction of the longitudinal strut 2. The outer web 34 is an extension of the side wall 40 of the box profile-like support 26, the web 38 is arranged near the long side 22 of the longitudinal strut 2 and defines a groove 42 therewith, and the web 36 is arranged between the web 34 and the web 38.

Between the web 34 and the web 36 there is placed a sealing strip 44, which may consist for example of rubber, extends over the entire length of the longitudinal strut and in the non-compressed condition projects slightly beyond the upper edges of the webs 34, 36.

In each upper region of the two long sides 22, 24 there is arranged a downward pointing web 46 parallel to the long sides and extending over the entire length of the long sides, which webs 46 define a groove 48 between themselves and the adjacent side walls 22 and 24 respectively. The opposing grooves 42, 48 serve to receive springs 50 which are described below further in detail.

Figure 5:
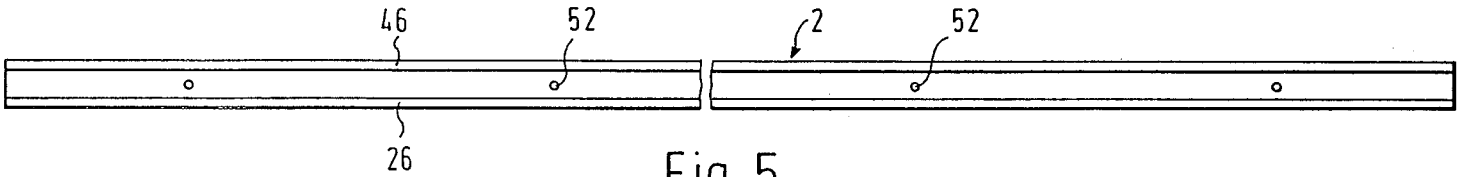
FIG. 5 is a side view of a longitudinal strut according to FIG. 1.

As can be seen in FIG. 5, in the long sides 22, 24 of the longitudinal struts 2, approximately halfway up, there are provided through bores 52 in a given grid distance of e.g. 60 cm for receiving screws 54 which serve to secure the transverse struts 4 to the longitudinal struts 2 in a force-locking manner. The entire width of the longitudinal struts 2 including their supports 26 can be about 10 cm, the height about 7.2 cm.

In order to obtain a transverse stiffening of the longitudinal struts, zinc-plated grate angles with additional diagonal struts as thrust traverses are provided at a distance of e.g. 100 cm.

Figure 1:
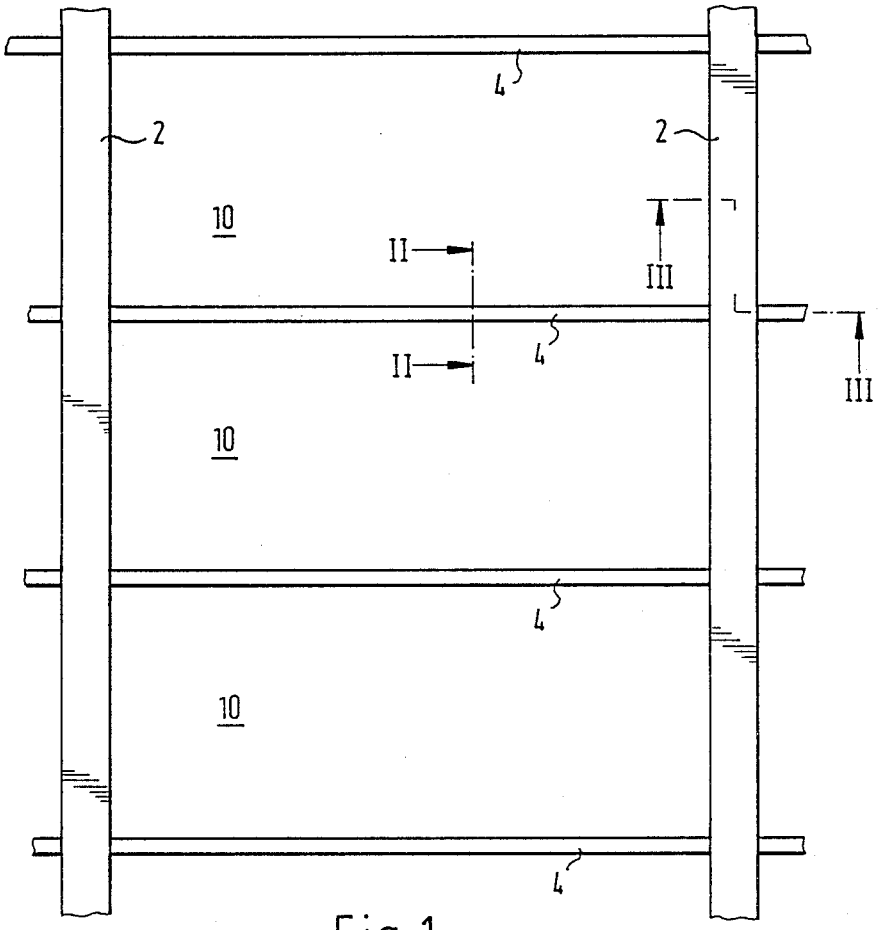
Figure 2:
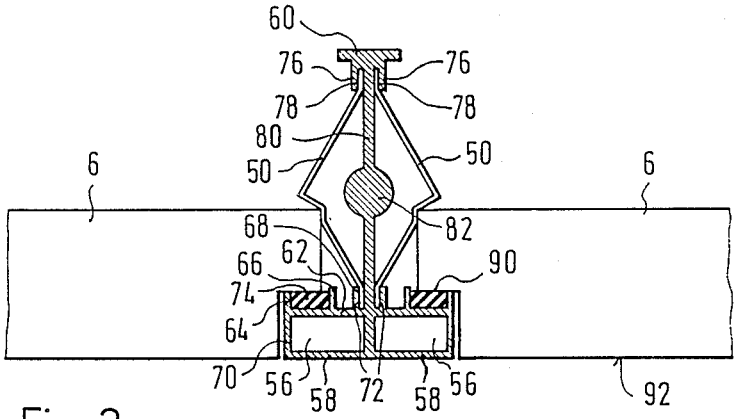
FIG. 2 is a partial sectional view through a transverse strut along the line II/II of FIG. 1, with cassettes in the assembled condition.

The structure of the transverse struts 4 can be seen particularly from FIG. 2. The transverse struts 4 are also designed as aluminium profiles and comprise an upright ridge 80, along the lower end of which there are arranged supports 56 extending in the longitudinal direction on both sides of the ridge 80. The undersides 58 of the supports 56 are at the same time the undersides of the transverse struts. The supports 56 have the same cross-section as the supports 26 of the longitudinal struts 2 and consequently have the form of a box profile with side walls 70 and top sides 62, from which longitudinal webs 64, 66, 68 extend upwards. Further, sealing strips 74 are arranged between the webs 64, 66, and grooves 72 are defined between the webs 68 and the adjacent side face of the ridge 80.

Along the upper end of the ridge 80, similar as in the case of the longitudinal struts 2, there are arranged downward pointing webs 76 extending in the longitudinal direction which define grooves 78 between themselves and the adjacent lateral faces of the ridge 80. As in the case of the longitudinal struts 2, the opposing grooves 72, 78 serve to receive the end portions of the springs 50. Along the upper edge of the transverse struts 4 there is arranged a stiffening rib 60 extending at right angles to the plane of the ridge 80.

The ridge 80 has a substantially centrally disposed thickening 82 extending in the longitudinal direction of the ridge 80. In the center of the thickening 82 there is disposed a taphole 84 extending in the longitudinal direction of the transverse strut 4. As can be seen in FIG. 3, the lower edges of the transverse struts 4 are provided with step-like rectangular recesses 86 which are dimensioned such that, when the transverse struts 4 are applied to the longitudinal struts 2, the upper horizontal surfaces of the recesses 86 of the transverse struts 4 rest on the supports 26 and simultaneously the front faces 87 of the transverse struts 4 lie against the outsides of the webs 46 of the longitudinal struts 2. In the case of the embodiment described herein, the width of the transverse struts 4 may be about 4 cm, and the height of the transverse struts 4 corresponds to the height of the longitudinal struts 2 and is thus 7.2 cm.

For fastening the transverse struts 4 to the longitudinal struts 2, the screws 54 are guided from the interior of the longitudinal struts 2 through the through-bores 52 of the long sides 22, 24 of the longitudinal struts 2 and tapped into the tapholes 84 of the transverse struts 4 which face the through-bores 52.

The dimensions of the cassettes 6 are somewhat smaller than the grid sizes defined by the long sides 22, 24 of the longitudinal struts and the outsides of the ridge 80 of the transverse struts, but larger than the grid sizes defined by the side walls 40, 70 of the supports 26, 56. Along their lower outer edge the cassettes 6 have a circumferential step-like fold 88. When the cassettes 6 are positioned in the grid compartments 10 defined by the longitudinal struts 2 and the transverse struts 4, the horizontal surfaces 90 of said step-like folds 88 rest in a tight manner on the sealing strips 44, 74 which are carried by the supports 26, 56. The height of the step-like folds 88 is such that the undersides 92 are flush with the undersides of the longitudinal struts 2 and of the transverse struts 4.

For fixing the position of the cassettes 6 there are provided the springs 50 which are secured to the longitudinal struts 2 and the transverse struts 4. At each of their two ends the springs 50 have a leg extending parallel to the long sides 22, 24 and to the ridge 80 respectively, the lower leg of the spring 50 being guided in the grooves 42 and 72 respectively, and the upper leg of the spring 50 being guided in the upper grooves 48 and 78 respectively. The central portion of the spring 50 comprises a vertical leg 94 which lies against the side wall of the cassette 6 in the region of the upper edge thereof, extends upward as far as the upper edge 96 of the cassette, and is tensioned against the cassette. The vertical leg of the spring 50 is followed by a short leg 98 sloping upward and inclined outward. From the outer end of said leg 98 a leg 100 extending in a straight line leads to the upper end section of the spring 50 which is guided in the grooves 48 and 78 respectively. From the lower end of the vertical leg 94 another leg 102 of the spring 50 extending in a straight line leads to the lower end section of the spring 50 which is guided in the grooves 42 and 72 respectively.

In the embodiment described herein, for each cassette 6 six springs 50 are distributed along the longitudinal struts 2 and the transverse struts 4. By compressing the legs 100, 102 the springs 50 can be inserted in a simple manner into the guide grooves at the respective desired positions. Also, if required, the springs 50 can be displaced inside the guide grooves. When the cassettes are being inserted into the grid compartments 10, the lower edges of the cassettes 6 impinge upon the legs 100 of the springs 50, pushing them laterally away. As soon as the cassettes have reached their desired position shown in the Figures, the legs 98, 100 of the springs 50 snap outward over the upper edge of the cassettes 6, and simultaneously the vertical legs 94 come to lie against the lateral faces of the cassettes 6. In this way, the cassettes 6 are safely supported in their final position.

Figure 6:
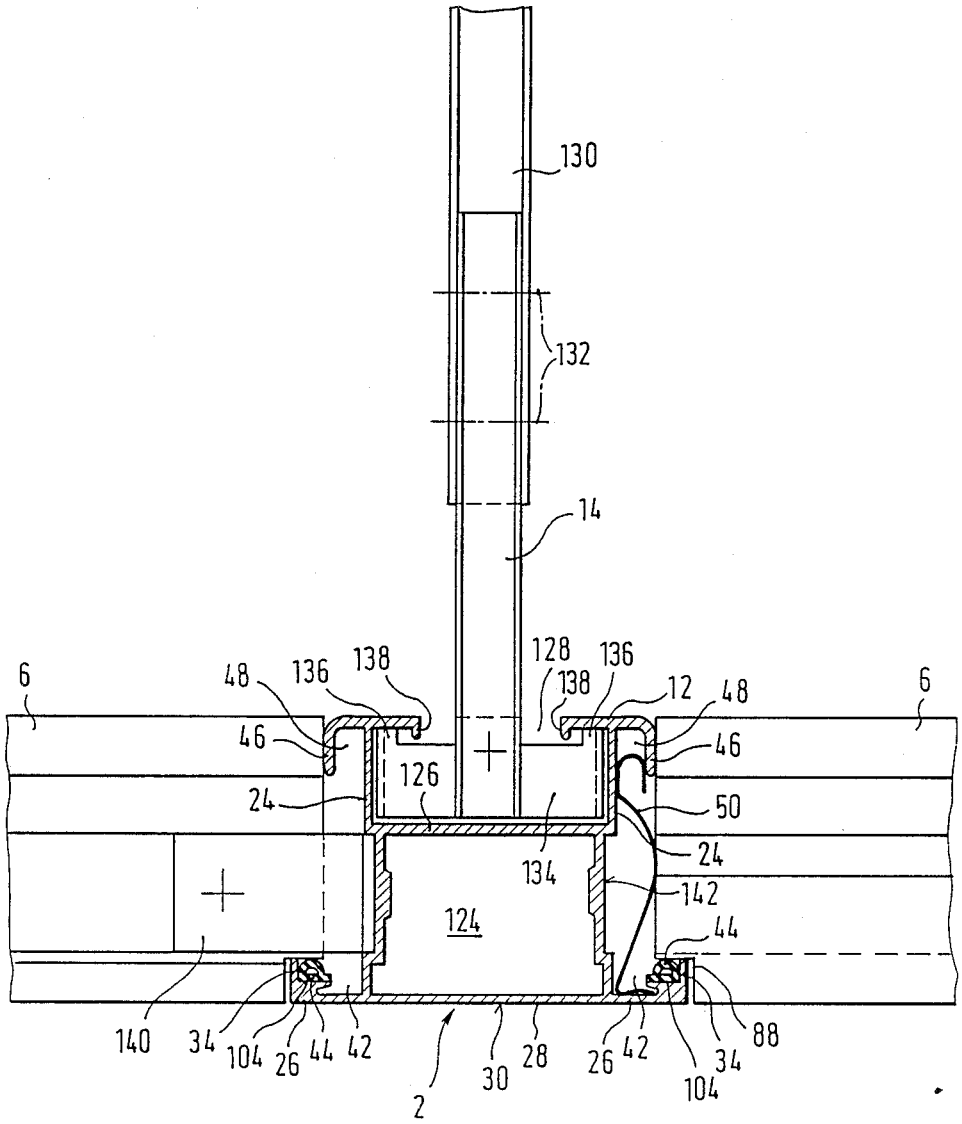
FIG. 6 is a sectional view of another embodiment of a longitudinal strut, similar to that of FIG. 3.

FIG. 6 is a sectional view, similar to that of FIG. 3, taken through a longitudinal strut of the supporting grid according to the invention, which corresponds substantially to the structure of the longitudinal strut shown in FIG. 3. Equal parts have been designated with the same reference numerals. The projections 26 of the longitudinal struts shown in FIG. 6 are provided with upward extending webs 34, upon which, as shown, the cassettes 6 come to lie with a horizontal surface of the step-like fold 88. It is thus ensured that the cassettes are always in close contact with the webs 34 so that the arrangement of the undersides 30 of the longitudinal struts and of the undersides of the cassettes 6 can be exactly matched and aligned. In the interspace defined between the long side 24 of the longitudinal strut and the web 34 there is disposed a seal 44 which has a plane lower contact surface 104 which can be joined with a horizontal area of the projection 26, for instance by means of an adhesive connection. The seal 44 is substantially tubular, and in the unloaded condition it has a height which is larger than the corresponding height of the web 34. In this way it is ensured that the seal 44 is always compressed to a given extent when the cassettes are placed thereupon.

The longitudinal strut shown in FIG. 6 is designed as a hollow profile and has a substantially rectangular, closed duct 124 which is defined by the underside 30, the long sides 24 and a horizontally extending separating web 126. The duct 126 is thus self-contained and sealed off against the superposed region of tubular cross-section 128. The region of tubular cross-section has a substantially U-shaped design, into which the suspension tongue 14 may be introduced as shown in FIG. 6.

The duct 124 can be used for leading electrical cables or pipes, for example for a sprinkler installation, therethrough. As it is sealed off by the separating web 126, it is also possible to attach ancillary devices on the underside 30 of the longitudinal strut 2, such as partitions, additional lights or the like, without impairing the tightness of the ceiling lining.

In the embodiment shown in FIG. 6, the suspension tongue 14 is connected to a suspended fixture 130, the attachment being effected by bolts or screws 132 which are indicated only schematically.

Similar to the embodiment shown in FIG. 3, the longitudinal strut has upper and lower grooves 48 and 42 respectively, which serve to hold a spring 50 or a spring member. FIG. 6 shows on its right hand side the embodiment of such a spring member 50.

In order to ensure a safe fastening to the suspension tongue 14, said tongue has a lower transverse region, at the upper outer edges of which there are arranged upward extending supporting tongues 136 which can be inserted into U-shaped grooves defined by the edges 138 of the top sides 12. In this way, disengagement of the suspension tongue 14 is safely excluded even when swingings or vibrations occur.

Attachment between the longitudinal strut 2 and a transverse strut 4 can be effected by means of an angle 140 which is provided in a longitudinal groove 142 of the long side 24 of the longitudinal strut 2. The angle 140 can be screwed for example with the longitudinal strut 2.

Figure 7:
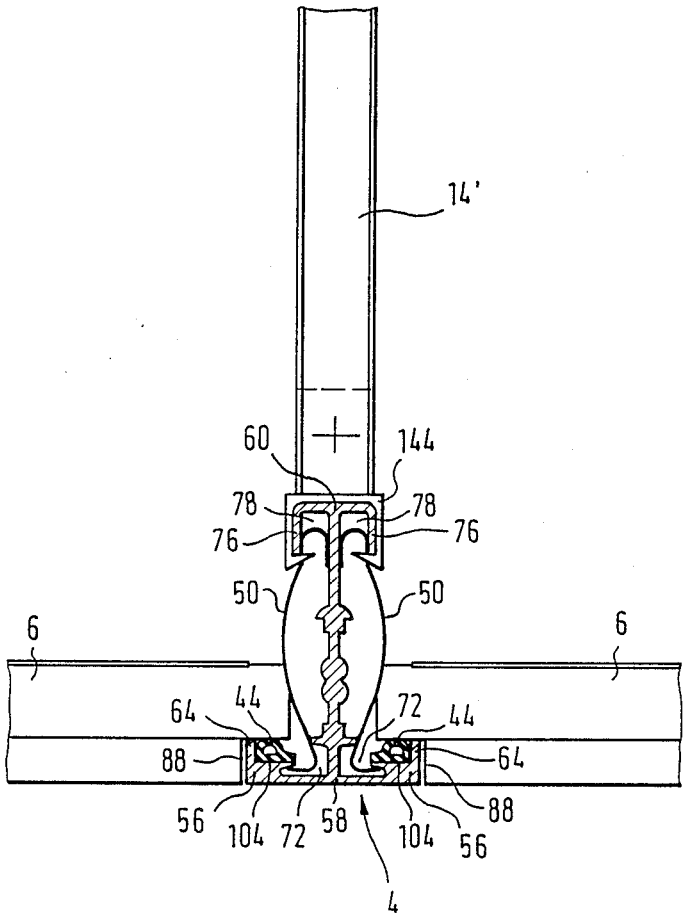
FIG. 7 is a sectional view of another embodiment of a transverse strut, similar to that of FIG. 2.

FIG. 7 shows the embodiment of a transverse strut, similar to FIG. 2, which in respect of its lateral structure is analogous to the longitudinal strut shown in FIG. 6. Also in this transverse strut the webs 64 are designed such that the step-like folds 88 of the cassettes come to lie upon the webs 64, but not on the seals 44. The seal 44 has the same design as in the embodiment shown in FIG. 6. Likewise the upper and lower grooves 78 and 72 respectively for receiving the spring members 50 are designed in the same way.

The transverse strut shown in FIG. 7 can be suspended by means of a suspension tongue 14' which has at its lower end a holding member 144 of substantially U-shaped cross-section, by which the upper portion of the transverse strut can be embraced. As shown in FIG. 7, the free ends of the holding member 144 are bent inward to engage the webs 76. Since not only the spring 50 but also the suspension tongues 14' extend only over a limited length of the transverse strut, there will not occur any undesired interaction between these two.

Figure 8:
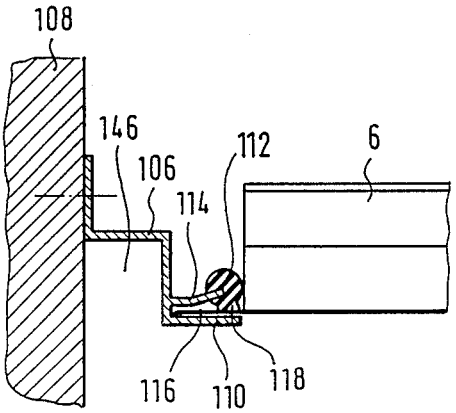
FIG. 8 is a sectional side view of a first embodiment of a wall end strut.
Figure 9:
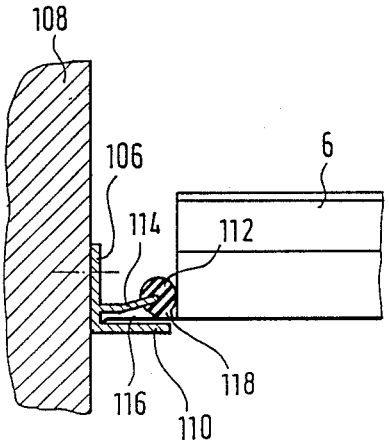
FIG. 9 is a view of another embodiment of a wall end strut, similar to that of FIG. 8.

FIGS. 8 and 9 show embodiments of a wall end strut according to the invention, by means of which the junction of a cassette 6 to the wall can be designed depending on the local conditions. The cassette 6 has a horizontal portion 116 which may be for instance a part of the underside of the cassette 6.

The wall end strut 106 has a first horizontal projection 110, upon which the horizontal portion 116 of the cassette 6 can be placed. Due to this design the cassette 6 is safely supported. Substantially parallel to the first projection 110 there is arranged a second projection 114 in one piece with the wall end strut 106. At the free end of said second projection 114 there is disposed a seal 112 which embraces the projection 114 and has at its underside at least one sealing lip 118 which is tensioned against the first projection 110. Thus, when the horizontal portion 116 is introduced, a reliable sealing is provided.

As shown in FIG. 9, the wall end strut 106 may have the form of an angle profile which can be screwed to a wall 108. However, as shown in FIG. 8, it is also possible to design the wall end strut 106 in form of a double-angle profile in order to form a shadow groove 146 in this way.

Figure 10:
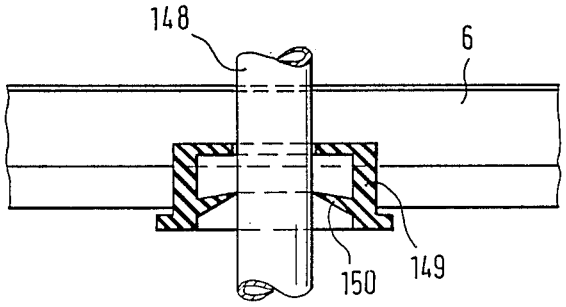
FIG. 10 is a sectional view taken through a cassette with an ancillary device in form of a pipe.

FIG. 10 shows an embodiment of a fitting (ancillary device) in a cassette 6. The fitting is designed as a pipe 148 which is shown only schematically and which can be used for example for a sprinkler installation. In a clearance of the cassette 6 there is placed an annular seal 149 which has an annular sealing lip 150 which sits close to the external surface of the pipe 148, thus providing a tight joint. The pipe 148 may be fastened either to the cassette 6 or to a ceiling arranged thereabove.

Figure 11:
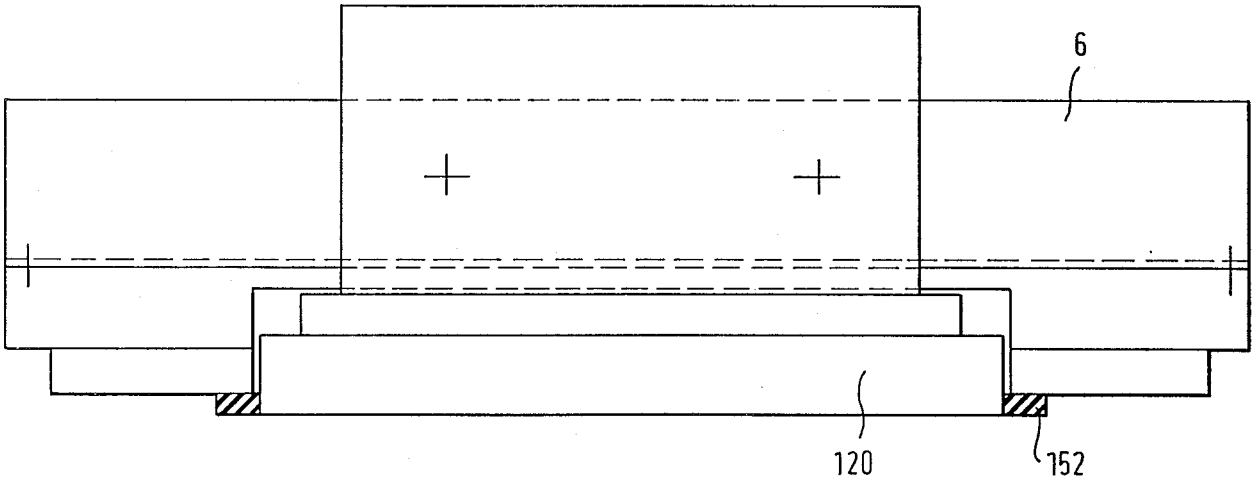
FIG. 11 is a sectional view taken through a cassette with an ancillary device in form of a lamp.

FIG. 11 shows another embodiment of a fitting (ancillary device) in a cassette 6, in form of a light 120 which is shown only schematically. The light 120 is fixedly connected with the cassette 6 and has a housing which is closed at the top side. The gas-tight sealing between the light 120 and the cassette 6 is achieved by a seal 152. The light 120 is mounted and dismounted together with the cassette 6.

Figure 12:
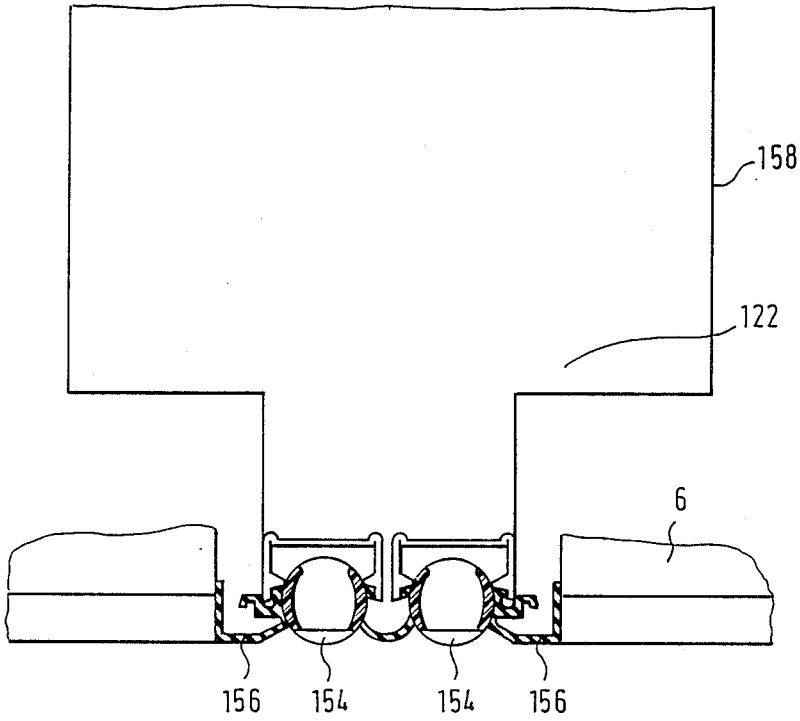
FIG. 12 is a sectional view taken through a cassette with an ancillary device in form of an air case.

FIG. 12 shows another embodiment of a fitting in a cassette, said fitting being an air supply or air discharge apparatus 122. A box 158 of the air installation 122 is sealed off against the top side of the cassette by means of seals 156 which are tightly attached to the cassette 6 and which may serve at the same time for supporting air nozzles 154. Also in such design it is possible to connect the air installation 122 with the cassette in a fixed manner.

Figure 13:
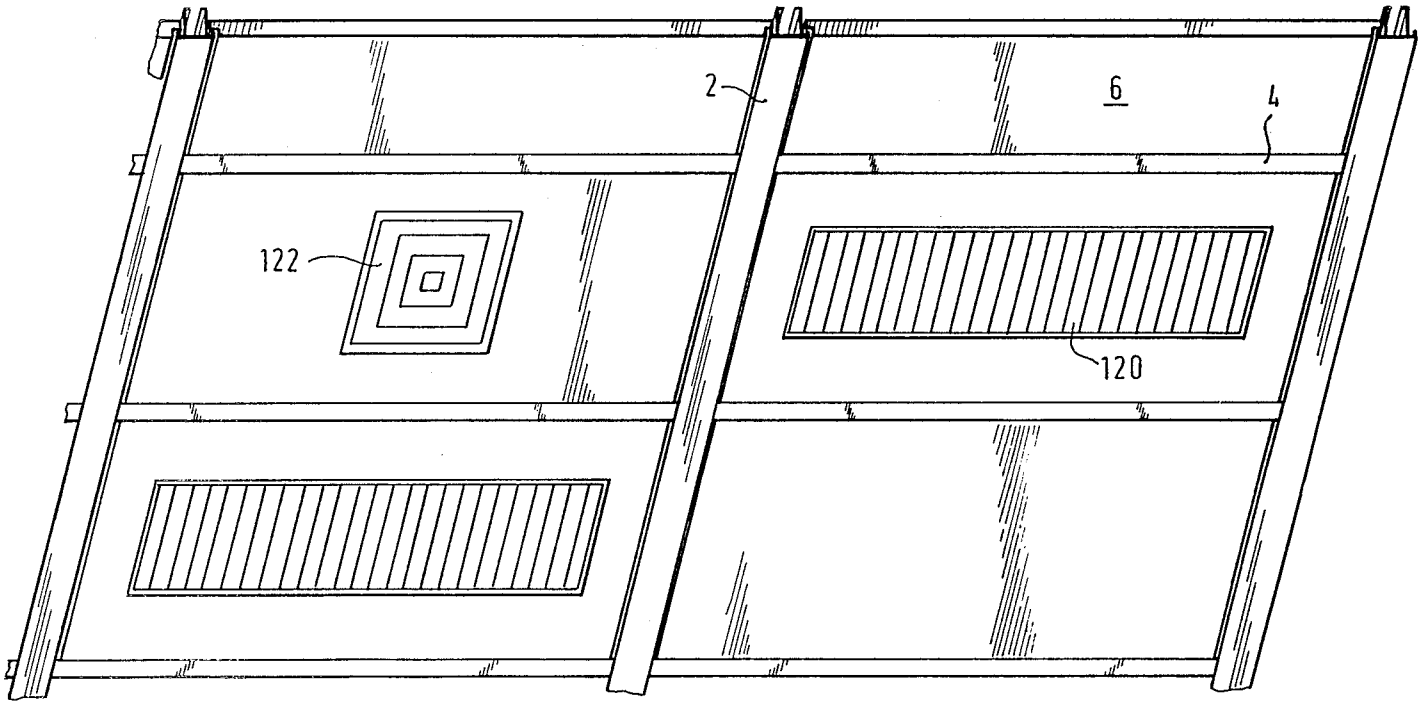
FIG. 13 is a perspective view from below of a ceiling lining according to the invention, with installations and cassettes in the assembled condition.

FIG. 13 is a perspective view from below of a ceiling lining according to the invention, in which between the longitudinal struts 2 and the transverse struts 4 there are mounted cassettes 6 which are partly equipped with light installations 120 or air installations 122.

The present invention is not restricted to the embodiments shown herein; rather there are numerous variations possible within the scope of the invention.

I claim:

1. Ceiling lining of metal, comprising a supporting grid and cassettes arranged in grid compartments of the supporting grid which is composed of longitudinal struts and of transverse struts connected to said longitudinal struts, each longitudinal strut and each transverse strut having projections which are arranged on either side at lower ends of said struts and which extend in the longitudinal directions thereof, are provided with seals, the cassettes resting upon said seals in a tight sealing engagement therewith, the longitudinal struts being designed as essentially rectangular hollow profiles, characterized in that the hollow profile is designed in the form of a closed duct and that further the longitudinal strut has a region of substantially hollow cross-section for mounting suspension elements, the duct is arranged in the middle section of the longitudinal strut and the region of the substantially hollow cross-section is arranged above said duct, said region of the substantially hollow cross-section is substantially U-shaped such that suspension elements can be suspended therein, the longitudinal strut is substantially rectangular in cross-section and comprises a horizontal separating web for separating the duct from the region of substantially hollow cross-section, the cassette has a circumferential step-like fold extending along its lower outer edge and resting with a horizontal surface of said step-like fold upon the projections in such manner that bottom portions of the cassette, the longitudinal strut and the transverse strut are substantially co-planar, and spring members are mounted on longitudinal struts or on transverse struts to secure the cassettes in position.

2. Ceiling lining according to claim 1, characterized in that the spring members are designed as leaf springs, the ends of said leaf springs being supported in grooves which are arranged opposite each other in the side wall of the longitudinal and transverse struts.

3. Ceiling lining according to claim 2, characterized in that the grooves are defined by the respective side wall and a parallel web extending downward from the upper end of the side wall, and by a web which is arranged on the top side of the projection and extends upward parallel to the side wall.

4. Ceiling lining according to claim 2, characterized in that the spring members have between their two ends an angular portion having a first leg extending in a substantially vertical direction, said first leg resiliently supported against the cassette and extending approximately as far as the upper edge of the cassette, and a second leg which extends above the upper edge of the cassette and is angularly bent, sloping upward and inclined outward with respect to the side wall of the struts.

5. Ceiling lining according to claim 4, characterized in that said first leg is followed by a leg extending preferably in a straight line to the lower groove, and that said second leg is followed by a leg extending preferably in a straight line to the upper groove.

6. Ceiling lining according to claim 5, characterized in that each of the legs of the spring members which extend to the grooves is followed by a spring end section which extends parallel to the side wall of the strut.

7. Ceiling lining according to claim 6, characterized in that the side walls of the longitudinal struts have through-bores and the front faces of the transverse struts have tapholes facing the through-bores for receiving fastening screws.

8. Ceiling lining according to claim 7, characterized in that transverse struts have at least at their end sections thickened portions which extend in the longitudinal direction of the transverse struts and which are provided with tapholes.

9. Ceiling lining according to claim 8, characterized in that a horizontal stiffening rib is arranged along the upper end of the transverse strut.

10. A ceiling lining comprising a supporting grid having interconnected longitudinal and transverse strut members defining an open grid compartment, said longitudinal and transverse strut members having lateral projections arranged on either side at lower ends thereof and running substantially along the entire length thereof for supporting a cassette in said open grid compartment, said projections provided with seal means which sealingly engage the cassette supported on the projections, said strut members provided with spring means on either side to bias said cassette into sealing engagement with said seal means, wherein said longitudinal strut member is substantially hollow in cross-section and includes a hollow region open at an upper end for mounting the strut on a suspension element and an enclosed duct separate from said hollow region.

11. Apparatus as defined in claim 10, wherein said duct is defined by said lateral projection.

12. Apparatus as defined in claim 10, wherein said duct is formed below said hollow region in said strut by an internal web.

13. Apparatus as defined in claim 10, wherein said hollow region is substantially U-shaped.

14. Apparatus as defined in claim 10 wherein said cassette has a peripheral step-like fold extending along a lower outer edge, said step-like fold having a horizontal surface which rests on said projections such that the undersides of the cassette, the longitudinal strut and the transverse strut are essentially co-planar when the cassette is supported in said open grid compartment.

15. Apparatus as defined in claim 10, wherein said spring members are leaf springs, the ends of which are supported in opposing upper and lower grooves in the side walls of said longitudinal and transverse struts.

16. Apparatus as defined in claim 15, wherein the upper grooves are defined by the side wall and a parallel web extending downward from the upper end of the sidewall, and the lower grooves are defined by the sidewall and a parallel web extending upward from said projection.

17. Apparatus as defined in claim 16, wherein the spring members comprise between their two ends an angular portion having a first leg extending in a substantially vertical direction, said first leg resiliently supported against the cassette and extending approximately as far as the upper edge of the cassette, and a second leg which extends above the upper edge of the cassette and is angularly bent, sloping upward and inclined outward with respect to the side wall of the struts.

18. Ceiling lining according to claim 17, characterized in that said first leg is followed by a leg extending preferably in a straight line to the lower groove, and that said second leg is followed by a leg extending preferably in a straight line to the upper groove.

19. Ceiling lining according to claim 18, characterized in that each of the legs of the spring members which extend to the grooves is followed by a spring end section which extends parallel to the side wall of the strut.

20. Ceiling lining according to claim 19, characterized in that the side walls of the longitudinal struts have through-bores and the front faces of the transverse struts have tapholes facing the through-bores for receiving fastening screws.

21. Ceiling lining according to claim 20, characterized in that transverse struts have at least at their end sections thickened portions which extend in the longitudinal direction of the transverse struts and which are provided with tapholes.

22. Ceiling lining according to claim 21, characterized in that a horizontal stiffening rib is arranged along the upper end of the transverse strut.

23. A ceiling lining comprising a supporting grid having interconnected longitudinal and transverse strut members defining an open grid compartment, said longitudinal and transverse strut members having lateral projections arranged on either side at lower ends thereof and running substantially along the entire length thereof for supporting a cassette in said open grid compartment, said projections provided with seal means which sealingly engage the cassette supported on the projections, said cassette having a peripheral step-like fold extending along its lower outer edge, said step-like fold having a horizontal surface which rests on said projections such that the undersides of the cassette, the longitudinal strut and the transverse strut are essentially co-planar when the cassette is supported in said open grid compartment.

* * * * *